US006797141B1

(12) United States Patent
Ludwig et al.

(10) Patent No.: US 6,797,141 B1
(45) Date of Patent: Sep. 28, 2004

(54) REMOVAL OF COAGULATES FROM A NON-GLARE ELECTROPLATING BATH

(75) Inventors: Ralf Wilhelm Ludwig, Grevenbroich (DE); Gerd Schöngen, Baesweiler (DE); Elmar Tolls, deceased, late of Willich (DE), by Hiltrud Tolls, legal representative

(73) Assignee: Enthone Inc., West Haven, CT (US)

( * ) Notice: Subject to any disclaimer, the term of this patent is extended or adjusted under 35 U.S.C. 154(b) by 0 days.

(21) Appl. No.: 10/148,090

(22) PCT Filed: Nov. 21, 2000

(86) PCT No.: PCT/US00/30148

§ 371 (c)(1),
(2), (4) Date: Oct. 3, 2002

(87) PCT Pub. No.: WO01/38610

PCT Pub. Date: May 31, 2001

(30) Foreign Application Priority Data

Nov. 25, 1999 (DE) ..... 199 56 666

(51) Int. Cl.[7] ..... C25D 21/06

(52) U.S. Cl. ..... 205/98; 205/99; 205/101; 205/259; 205/271; 205/650; 205/673

(58) Field of Search ..... 205/98, 99, 101, 205/259, 271, 650, 673

(56) References Cited

U.S. PATENT DOCUMENTS 3,922,208 A 11/1975 Cordone et al.
4,102,755 A * 7/1978 Brugger et al. ..... 205/109
4,102,756 A 7/1978 Castellani et al.
4,756,816 A * 7/1988 Liao et al. ..... 205/50
5,312,539 A 5/1994 Thomson
5,573,652 A 11/1996 Kiyama et al.
5,690,804 A 11/1997 Kuhlmann et al.
5,840,170 A 11/1998 Nagy
5,897,763 A * 4/1999 Elligsen et al. ..... 205/271

FOREIGN PATENT DOCUMENTS

DE 2015739 A 10/1971
FR 2384037 A 3/1977
JP 59107092 A 6/1984

OTHER PUBLICATIONS

Supplementary European Search Report for EP 00 98 0265 dated Jan. 16, 2003.
Brugger, Robert, "Die galvanische Vernicklung", 1984, pp. 182–189, Eugen G. Leuze Verlag, Germany, no month given.

* cited by examiner

*Primary Examiner*—Robert R. Koehler
(74) *Attorney, Agent, or Firm*—Senniger Powers

(57) ABSTRACT

The invention deals with the technical problem to devise a process for the extended use of electrolytes which economically ensures a high electrolyte quality without having to accept production interruptions for regeneration. Especially, it is envisaged to conduct the process for the precipitation of non-glaring metal coatings in such a manner that work can proceed in three shifts for five days per week, without encountering production interruptions due to coagulation of the fine dispersal phase, respectively, and without the additional operating cost of a heating/cooling circuit. The invention solves the problem in that during the extended use of an electrolyte a partial flow is split off which is filtered and, if applicable, regenerated by the addition of active substances and reintegrated in the operating cycle.

7 Claims, No Drawings

REMOVAL OF COAGULATES FROM A NON-GLARE ELECTROPLATING BATH

BACKGROUND OF THE INVENTION

The invention refers to a process for the extended use of electrolytes, especially for depositing of non-glare metal coatings on a metal surface.

It is understood that metal coatings also include metal alloy coatings, and metal surfaces also include metallized surfaces of non-metallic objects.

The electrolytes used for plating generally are based on the customary, known composition components for the particular metal being plated. For example, in the case of nickel deposits from Watts nickel type electrolytes, these would be nickel sulfate, nickel chloride and boric acid.

Electrolytes based on chloride, sulfate, sulfamate, fluoroborate or mixtures thereof may be used for the metals nickel, copper, zinc, tin as well as for noble metals. In addition, the electrolytes may contain selected organic or inorganic base brighteners, grain improvers, brighteners or complexing agents.

In order to achieve absence of glare, a finely dispersed system is generated in the electrolyte by the addition of inorganic or organic foreign materials, so that these additives during the precipitation are either built into the deposit and/or interrupt for a short time the precipitation of the cathode film locally.

In the case of the known processes, finely ground insoluble materials, such as graphite, barium sulfate, aluminum oxide, glass etc. are added to the electrolyte. These products are maintained in suspension by strong agitation of the electrolyte and built into the deposit during the precipitation.

In modern processes the fine dispersal phase is generated in the electrolytes themselves. One or more surfactants are added to the solution which form a homogeneous solution below their cloud point, but form a finely dispersed emulsion above their cloud point.

As is the case with all emulsions, the stability of the fine dispersal phase is limited. Over time, the droplets increase in size and negatively affect the uniformity of the precipitation.

In practice, the emulsion is stabilized in that an electrolyte is continuously cooled to below the cloud point temperature, whereby the surfactant again goes into complete solution in the electrolyte. Subsequently, the electrolyte is again brought to the working temperature. The heating/cooling circuit required causes substantial additional operating cost.

If one works with an elevated salt content, the addition of a few milligrams per liter of selected surfactants already are sufficient to achieve a non-glare precipitation. Even without the forming of a visibly, cloudy emulsion, high-quality glare suppression is achieved. The surfactant may subsequently be readjusted several times, so that a worsening of the appearance of the layers due to coagulation occurs only after a period of 12–14 hours. The electrolyte functions without a secondary circuit. The coagulate may be removed by filtration over activated charcoal.

In addition, a fine dispersal phase may be generated by the reaction of soluble anionic and cationic combined with difficult-to-dissolve, higher-molecule salts in electrolytes. However, also in this case, after a working cycle of 8–10 hours the foreign material must be removed completely from the electrolytes by filtration due to coagulation effects. For the next working cycle the dispersion phase must be rebuilt again each time by the addition of components.

The higher-molecular compounds may also be directly added to the electrolytes.

Materials such as proteins or polysaccharides are present in aqueous solutions in colloidal form, and they lead to non-glaring coatings with suitable electrolyte compositions. These compounds are reduced by hydrolysis and/or reaction at the electrodes, and the glare removing property is increasingly destroyed.

SUMMARY OF THE INVENTION

The invention deals with the technical problem to prepare a process for the extended use of electrolytes which ensures a high electrolyte quality with a low economic investment, without having to accept production interruptions for regeneration.

Especially, it is envisaged to conduct the process for the precipitation of non-glaring metal coatings in such a manner that work can proceed in three shifts, five days per week without encountering production interruptions due to coagulation or destruction of the fine dispersal phase, respectively, and without the additional operating cost of a heating/cooling circuit.

The solution proposed by the invention is that during the continued use of an electrolyte a part of the flow is deviated, filtered and, if necessary, reconstituted by the addition of active substances and subsequently reintegrated in the operating cycle.

It is therefore suggested, in a partial flow of the electrolyte, to continually remove by filtration, wholly or in part, the coagulated particles and the not yet coagulated particles, as well as high-molecular compounds and their decay products, and that the appropriate quantity of additives is added to the filtrate prior to its reintegration.

DETAILED DESCRIPTION OF THE PREFERRED EMBODIMENT

Extended filtration means that filtration takes place primarily during the operating cycle.

A thorough cleaning of the electrolyte can be performed on weekends.

The invention describes a process for the extended use of electrolytes for the precipitation of non-glare metal coatings which, in addition to the metal salt, may also contain conducting salts, base brighteners, grain improvers and complexing agents in which a finely dispersed colloidal phase is generated in order to achieve non-glare properties. This is characterized by a partial flow of the electrolyte in which coagulated particles and not yet coagulated particles are removed wholly or in part by means of filtration and that an appropriate quantity of the active substances is subsequently added prior to reintegration.

A portion of the electrolyte can be directed into an overflow compartment for filtration. The overflow compartment should be able to contain between 5 and 25% of the actual bath volume.

Any type of filtration capable of removing very finely dispersed, finely dispersed and more grossly dispersed particles, wholly or in part, from the electrolyte may be employed. The different porosity of the filter materials and the use of filtration aids and/or activated charcoal may serve to differentiate between the various particle sizes.

Plate filters of defined porosity commonly employed in electroplating can be used, precoated with filtration aids and/or activated charcoal, as well as the common precoated multiple tube filters with defined porosity. Without precoating, wound tube filters may be used.

Also, classical methods of fractionating colloidal systems, such as dialysis, ultra and membrane filtration may be employed.

5–40% of the bath volume should be filtered per hour.

What is claimed is:

1. A process for extending the continuous operation of non-glare metal plating which employs an electrolyte bath comprising a non-glare material tending to coagulate under the non-glare metal plating operating conditions, the process comprising:

a. deviating an electrolyte flow from the electrolyte bath;

b. filtering the electrolyte flow to remove particles of glare-suppression material which have coagulated under the non-glare metal plating operating conditions; and c. returning the filtered electrolyte flow to the electrolyte bath.

2. The process of claim 1 wherein the non-glare material comprises a surfactant and wherein the non-glare metal plating operating conditions include operating at an electrolyte bath temperature above a cloud point temperature of the surfactant.

3. The process of claim 1 wherein the electrolyte flow that is deviated from the electrolyte bath in step a has a flow rate such that a volume of electrolyte between about 5% and about 40% of the volume of the electrolyte bath is filtered per hour.

4. The process of claim 1 wherein the filtering step comprises a filtration process selected from the group consisting of precoated plate filtration, precoated multiple tube filtration, wound tube filtration, dialysis, ultra filtration, and membrane filtration.

5. The process of claim 1 wherein the filtering of step b further comprises filtering the electrolyte flow to remove uncoagulated non-glare material.

6. The process of claim 1 further comprising the step of replenishing the electrolyte bath by adding an active substance to the electrolyte flow in an amount which is substantially equal to an amount of the active substance removed by consumption in the non-glare metal plating operation and by filtration from the electrolyte flow.

7. The process of claim 6 wherein the active substance is added to the electrolyte flow after the filtering step and prior to returning the electrolyte flow to the electrolyte bath.

* * * * *